US005471792A

United States Patent [19]

Higgins et al.

[11] Patent Number: 5,471,792

[45] Date of Patent: Dec. 5, 1995

[54] LATCH ENGAGED REMOVABLE MULLION ASSEMBLY

[75] Inventors: Anthony L. Higgins, Gahana; Michael P. Fox, Pataskala, both of Ohio

[73] Assignee: Von Duprin, Inc., Indianapolis, Ind.

[21] Appl. No.: 216,374

[22] Filed: Mar. 23, 1994

[51] Int. Cl.[6] ..... E06B 5/00

[52] U.S. Cl. ..... 49/365; 292/219

[58] Field of Search ..... 49/365, 466; 160/117, 160/118, 119; 292/219; 52/210

[56] References Cited

U.S. PATENT DOCUMENTS

| | | | |
|---|---|---|---|
| 1,533,620 | 4/1925 | Tobin et al. | 49/365 |
| 1,556,593 | 10/1925 | Eklind et al. | 49/365 |
| 1,639,037 | 8/1927 | Hollingshead | 49/365 |
| 1,687,997 | 10/1928 | Tobin et al. | 49/365 |
| 1,869,274 | 7/1932 | Phillips | 49/365 |
| 2,025,221 | 12/1935 | Tobin et al. | 49/365 X |
| 2,275,730 | 3/1942 | Casse | 49/365 |
| 2,709,910 | 6/1955 | Vigmostad | 292/219 X |
| 2,827,960 | 3/1958 | Keating et al. | 49/365 X |
| 2,920,358 | 1/1960 | Woodard | 49/365 |
| 3,000,062 | 9/1961 | McCandless | 49/365 X |

*Primary Examiner*—Jerry Redman

*Attorney, Agent, or Firm*—Robert F. Palermo; A. James Richardson

[57] ABSTRACT

A mullion assembly mountable in a door frame includes a bottom fitting attached to a floor and a top fitting attached to the door frame above the bottom fitting. The top fitting supports a latch engagement assembly for engaging a latch assembly positioned in a mullion cavity of a mullion. The latch assembly has a latch extendable from the mullion cavity to engage the latch engagement assembly supported by the top fitting and hold the mullion in a fixed position. Retraction of the latch is controlled by a key lock assembly connected to the latch assembly through an actuating link assembly. The key lock assembly permits key controlled disengagement of the latch from the latch engagement assembly, followed by temporary removal of the mullion from its position in the door frame.

12 Claims, 4 Drawing Sheets

LATCH ENGAGED REMOVABLE MULLION ASSEMBLY

BACKGROUND OF THE INVENTION

The present invention relates to a removable mullion assembly for a double door. More particularly, the present invention relates to a mullion assembly having an engagable latch controlled by a key cylinder lock mechanism.

Mullions are vertically oriented doorway inserts that allow use of single doors in double door frames. Conventionally, mullions are centered in a double doorway and attached with screws or bolts to fittings inset into the floor and the top of the door frame. Two strikes are provided on opposing sides of the mullion to accommodate latches of two single size doors that are respectively hinge mounted on opposite side of the door frame.

When unobstructed access through the double door is needed, conventional mullions must be unscrewed or unbolted from the inset fittings. This can be a time consuming and difficult procedure, and normally requires two people. One person must hold the mullion while the other person unscrews or unbolts the mullion from the fittings. However, repeated removal and replacement of the mullion can also cause problems, with the fittings tending to become loose with time, or screw threads being stripped or damaged.

To overcome this problem, removable mullions that do not require unscrewing or unbolting have been disclosed. For example, U.S. Pat. No. 2,275,730 discloses a mullion capable of being seated in a floor bracket and swung forward to permit a latch bolt to snap into abutting relation with a tooth, holding the mullion in position against a top bracket. The mullion can be released by an actuating chain that retracts the latch bolt into a housing beneath the tooth, permitting inward tilting and removal of the mullion. However, this type of arrangement is disadvantageous for many applications because the mullion release system is not protected, being subject to damage or unauthorized removal by vandals. What is needed is an easily removable mullion assembly that can be snapped into position, has a concealed latch bolt protected from damage, and is not removable by unauthorized persons.

The present invention uses a key controlled mechanism to provide such a vandal resistant mullion assembly. A mullion assembly in accordance with the present invention includes a bottom fitting attached to a floor and a top fitting attached to the door frame above the bottom fitting. In preferred embodiments, the bottom fitting includes protrusions configured to fit within the mullion cavity and hold the mullion in position, although other attachment mechanisms such as bolts, hinges, exterior stops, or other conventional holding mechanisms can also be employed.

The top fitting supports a latch engagement assembly such as a roller strike that downwardly extends from the top fitting. A mullion, defining a mullion cavity therein, is positioned between the bottom fitting and the top fitting, and a latch assembly is positioned in the mullion cavity. The latch assembly includes a platform supporting a latch that automatically extends from the mullion cavity in response to depression of an auxiliary bolt attached adjacent to the latch to engage the latch engagement assembly of the top fitting and hold the mullion in a fixed position.

Importantly, the latch can only be retracted by operation of a key lock assembly connected to the latch assembly by an actuating link assembly. This connection permits key controlled disengagement of the latch from the latch engagement assembly, followed by temporary removal of the mullion from its upright position in the door frame. In preferred embodiments, the key lock assembly includes a mortise key cylinder having a cylinder cam configured to downwardly move the actuating link assembly and retract the latch in response to turning a key in the mortise key cylinder.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one embodiment of the invention, the platform supports an actuating link assembly attached between the latch and the mortise key cylinder. To prevent unwanted retraction of the latch bolt absent movement of the actuating link assembly (and consequent disengagement of the latch), a deadlock arm assembly can be separately attached to the platform. The deadlock arm assembly is movable between a first position to block movement of the actuating linkage assembly and a second position to allow movement of the actuating linkage assembly. Movement of the deadlock arm assembly from its first position to a second position is automatic, and occurs in response to movement of the actuating link assembly. Typically, the deadlock arm is biased by a spring or other mechanism to normally move to its first position.

Further features, objects, and advantages of the present invention will become more apparent upon consideration of the accompanying claims, drawings, and the following description of those drawings.

DETAILED DESCRIPTION

Figure 1:
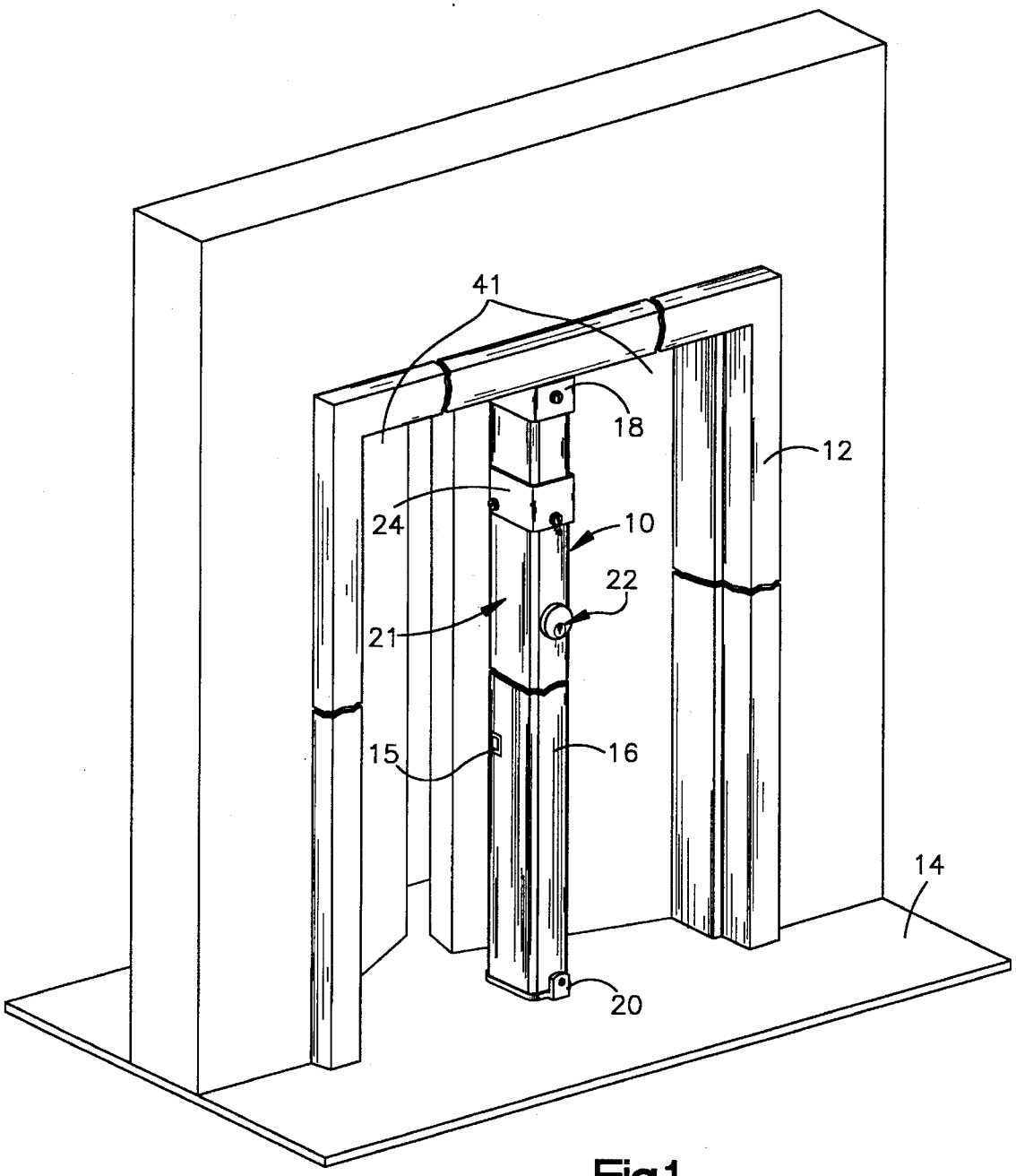
FIG. 1 is a perspective view of a double door frame having a removable mullion assembly in accordance with the present invention, the mullion assembly being mounted between top and bottom fittings centered in the door frame by an engage latch assembly.

As shown in FIG. 1, a mullion assembly 10 having door strike 15 is installed between a standard double door frame 12 with doors 41 and a floor 14. The mullion assembly 10 includes a mullion 16 having a guard 24 for engaging a top fitting 18. The top fitting 18 is permanently attached to the door frame 12, and as best seen in FIG. 4, supports a latch engagement assembly 25 that includes a roller strike 26.

Figure 2:
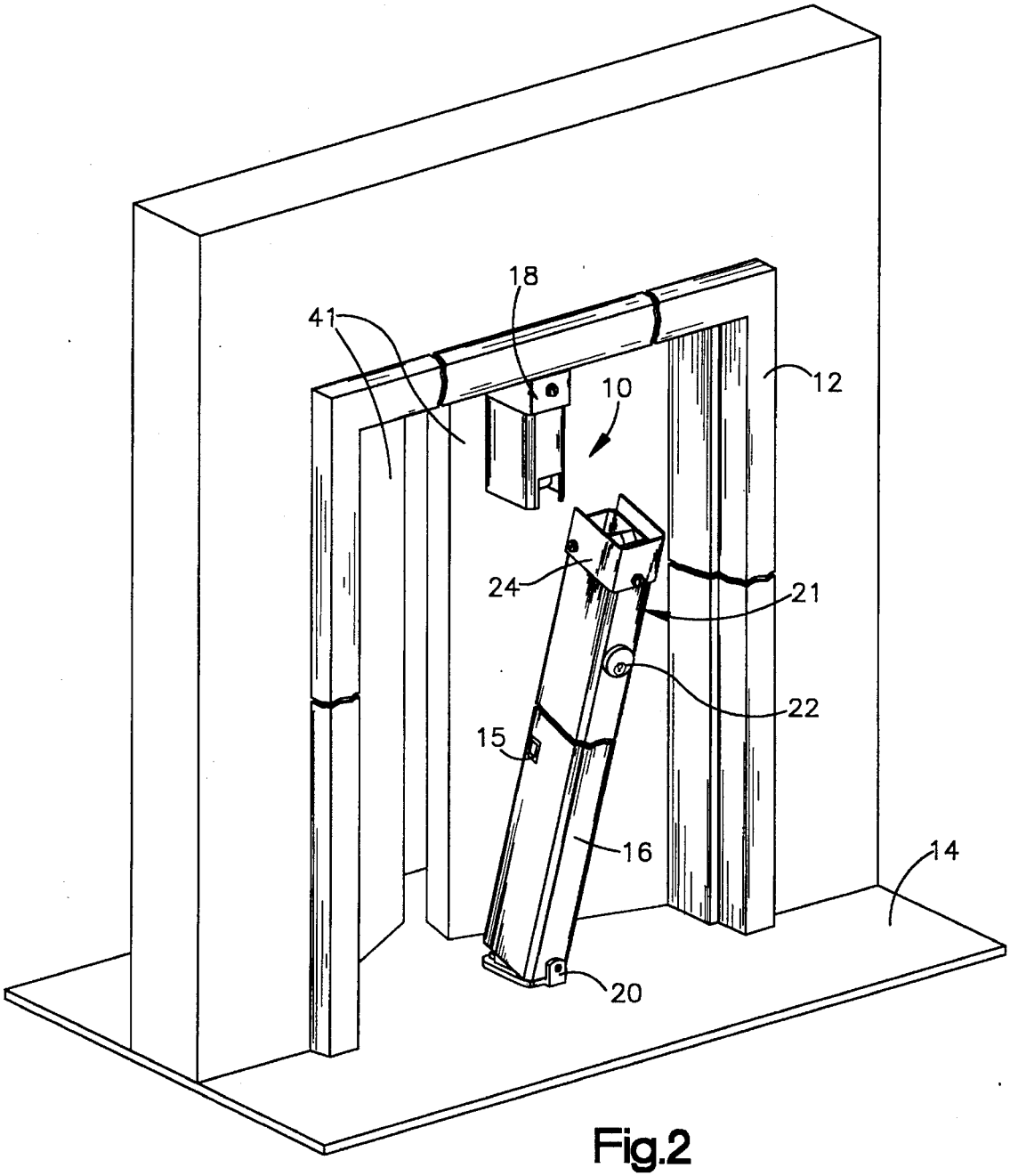
FIG. 2 is a perspective view of the mullion assembly of FIG. 1, the mullion assembly being partly removed by disengagement of the latch assembly and tilted forward prior to disengagement of the mullion from the bottom fitting.
Figure 3:
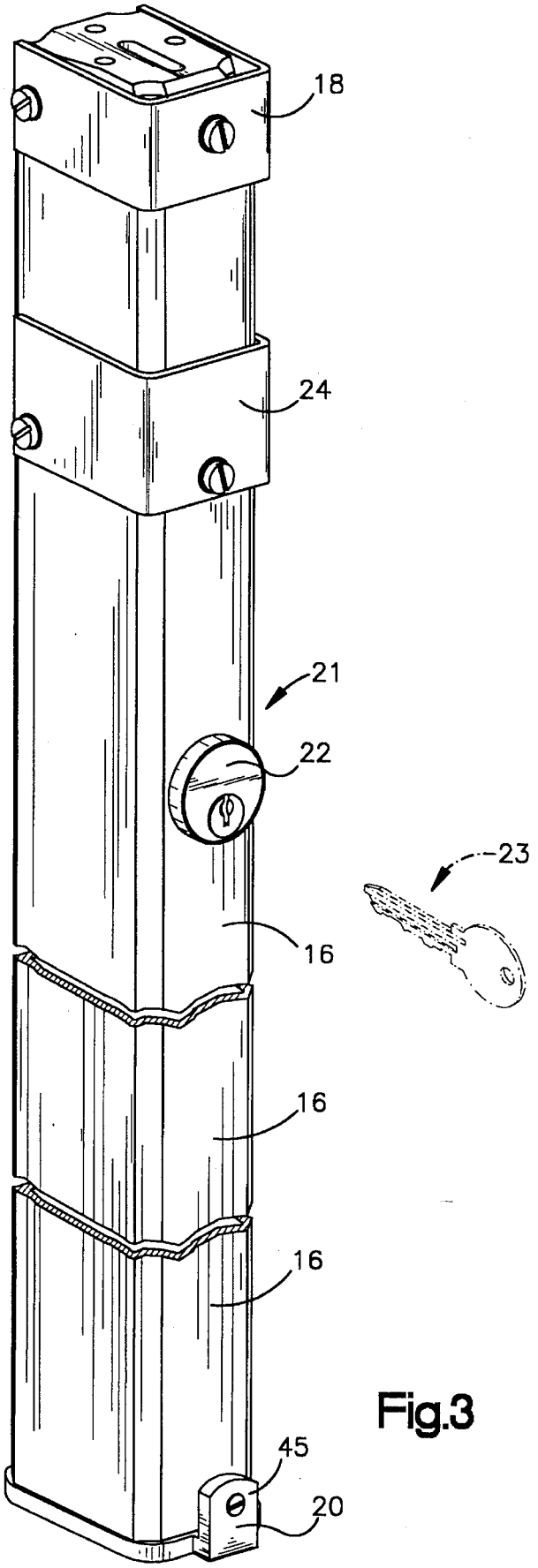
FIG. 3 is an external broken perspective view of the mullion assembly, illustrating top and bottom fittings, and a mortise key cylinder that controls disengagement of the latch assembly.
Figure 4:
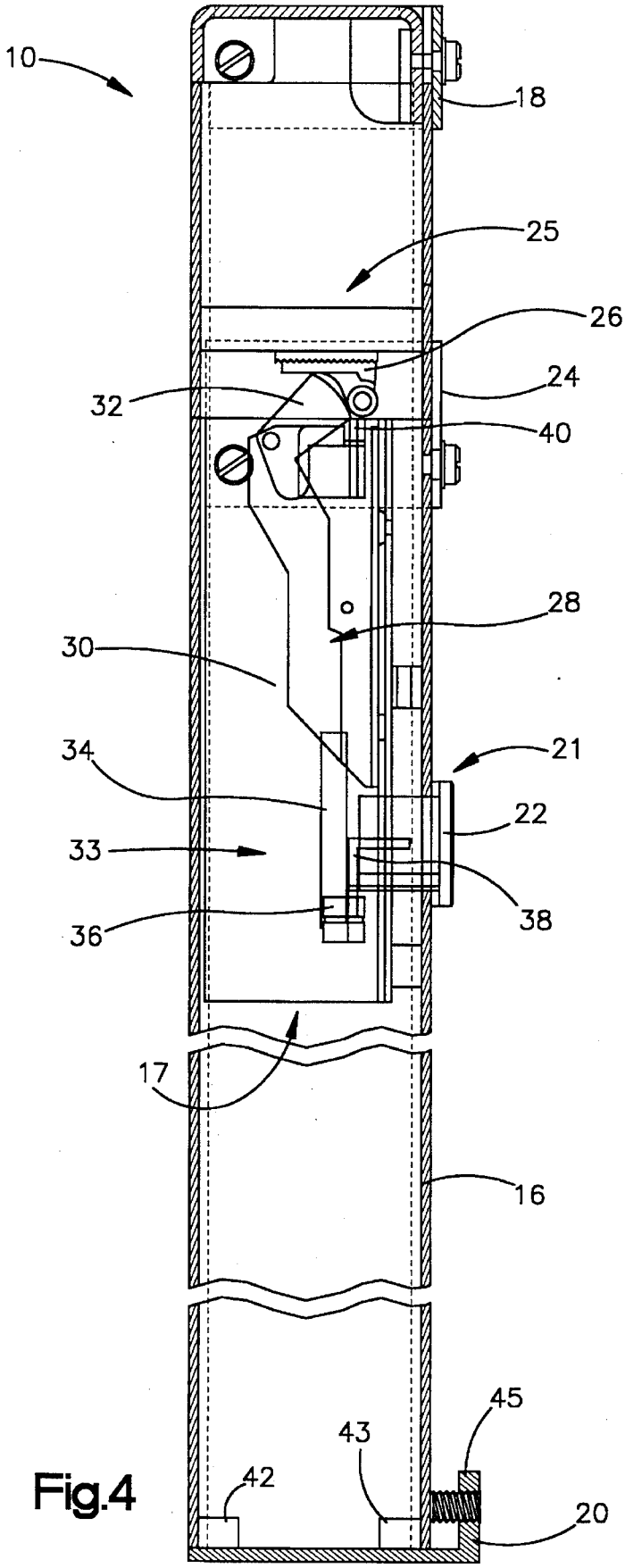
FIG. 4 is a cross sectional view of the mullion assembly of FIG. 3, illustrating the latch assembly engaged with a roller strike attached to the top fitting.

As best seen in FIGS. 3 and 4, the mullion 16 defines a mullion cavity 17. The mullion 16 can be constructed from steel or aluminum by conventional techniques such as extrusion, stamping, folding or other known metal working techniques. The cavity 17 is sized to hold both the mortise key cylinder 22 and a latch assembly 28. The mullion 16 also engages upwardly extending protrusions 42 and 43 of a bottom fitting 20 that is permanently attached to the floor 14. The protrusions are configured to fit inside the mullion cavity 17 and help hold the mullion 16 in a vertical position. As best seen with reference to FIG. 2, release and removal of the mullion 16 follows in response to activation of a key lock assembly 21 that includes a mortise key cylinder 22.

The mullion 16 also supports a latch assembly 28 that is configured to engage the latch engagement assembly 25. The latch assembly 28 is substantially similar to that previously described in U.S. Pat. No. 4,974,890 to Cohrs, assigned to Von Duprin, Inc, the disclosure of which is herein incorporated by reference. Except for certain modifications required to connect to the key lock assembly 21 by an actuating link assembly 33 (which includes latch rod 34 and latch cam follower 36), the latch assembly 28 of the present invention is identical to that disclosed in the Cohrs patent. The latch assembly 28 includes latch 32 and an auxiliary bolt 40, both supported by a platform 30 permanently installed to fit into mullion cavity 17. Installation of latch assembly 28 can involve keying emplacement, bolt attachment, permanent blocks, or any other conventional attachment mechanism.

To prevent unwanted retraction of the latch 32, a blocking, deadlock arm such as described in U.S. Pat. No. 4,974,890 can be employed to impede movement of latch 32. Typically, the deadlock arm is attached for pivotal movement by a rivet to the platform 30. The deadlock arm is further attached to a torsion spring to bias it toward engagement with the actuating link assembly 33. The deadlock arm must be moved from its normally spring biased first position to a second position before retraction of the latch is permitted. Normally, this automatically occurs as the actuating link assembly is operated. Absent normal operation of the actuating link assembly, the deadlock arm will remain in place and prevent retraction of the latch.

Release of the mullion 16 from its attachment between fittings 18 and 20 is simple and secure. A key 23 is inserted into mortise key cylinder 22 and rotated. A cylinder cam 38 rotates as the key 23 is turned, which in turn downwardly pulls the connected latch cam follower 36 and latch rod 34 of the actuating link assembly 33. The deadbolt is automatically moved out of its locking position, and the latch 34 retracts into the platform 30 and mullion cavity 17, breaking the locked connection between the latch assembly 28 and the latch engagement assembly 25. As seen in FIG. 2, the mullion 16 can then be pulled forward to break the connection between the mullion 16 and top fitting 18. This is followed by lifting the mullion 16 away from the protrusions 42 and 43 to break the connection with the bottom fitting 20. The mullion 16 can then be stored or set aside until it is again required.

Replacement of the mullion 16 is also simple. The mullion 16 is angled and positioned over the bottom fitting 20. The mullion 16 is then pivoted toward the top fitting 18. When the roller strike 26 of the latch engagement assembly contacts the auxiliary bolt 40, the auxiliary bolt is depressed downward. As discussed in U.S. Pat. No. 4,974,890, downward movement of the auxiliary bolt causes extension of the latch, which in turn lockably engages the roller strike 26. The mullion 16 remains locked in position until someone again retracts the latch 32 using key 23.

While the present invention has been described in connection with certain specific embodiments, it should be understood that the specific examples are not intended to limit the invention as set forth in the following claims.

What is claimed is:

1. A mullion assembly mountable in a door frame, the mullion assembly comprising:

a bottom fitting attached to a floor;

a top fitting attached to the door frame above the bottom fitting, the top fitting having a latch engagement assembly with a roller strike positioned to depress an auxiliary bolt;

a mullion defining a mullion cavity, the mullion being positionable in removable attachment between the bottom fitting and the top fitting;

a latch assembly positioned in the mullion cavity, the latch assembly having a latch extendable from the mullion cavity to engage the latch engagement assembly of the top fitting and hold the mullion in a fixed position; and a key lock assembly connected to the latch assembly by an actuating link assembly, permitting key controlled disengagement of the latch from the latch engagement assembly, followed by temporary removal of the mullion from its position in the door frame.

2. The mullion assembly of claim 1, wherein the key lock assembly comprises a mortise key cylinder having a cylinder cam configured to downwardly move the actuating link assembly and retract the latch in response to turning a key in the mortise key cylinder.

3. The mullion assembly of claim 1, wherein the latch assembly further comprises a latch triggered to extend upward from the mullion cavity in response to depression of said auxiliary bolt attached adjacent to the latch.

4. The mullion assembly of claim 1 wherein the bottom fitting further comprises protrusions configured to fit within the mullion cavity and hold the mullion in position.

5. A Mullion assembly mountable in a door frame, the mullion assembly comprising:

a latch engagement assembly attached to the door frame and having a roller strike positioned to depress an auxiliary bolt;

a mullion positionable in the door frame adjacent to the latch engagement assembly;

a latch assembly attached to the mullion, the latch assembly having a latch extendable to engage the latch engagement assembly and hold the mullion in a fixed position; and a key lock assembly connected to the latch assembly by an actuating link assembly, permitting key controlled disengagement of the latch from the latch engagement assembly, followed by temporary removal of the mullion from its position adjacent to the latch engagement assembly in the door frame.

6. The mullion assembly of claim 5, further comprising a bottom fitting attached to a floor and a top fitting attached to the door frame above the bottom fitting, with the top fitting supporting the latch engagement assembly.

7. The mullion assembly of claim 5, wherein the key lock assembly comprises a mortise key cylinder having a cylinder cam configured to move the actuating link assembly and disengage the latch from its connection with the latch engagement assembly in response to turning a key in the mortise key cylinder.

8. The mullion assembly of claim 5, wherein the latch assembly further comprises a latch triggered to extend upward from a mullion cavity defined by the mullion, the latch extending in response to depression of said auxiliary bolt which is attached adjacent to the latch.

9. A mullion assembly mountable in a door frame, the mullion assembly comprising:

means for engaging a latch, the means for engaging being attached to the door frame and comprising a roller strike positioned to depress an auxiliary bolt;

a mullion positionable upright in the door frame adjacent to the means for engaging the latch;

means for extending a latch to engage the means for engaging the latch and for holding the mullion in a fixed position, the means for extending the latch being attached to the mullion; and key operated means for retracting the latch and for permitting removal of the mullion from its upright position in the door frame.

10. The mullion assembly of claim 9, wherein the key operated means for retracting the latch further comprises a mortise key cylinder having a cylinder cam configured to move an actuating link assembly and disengage the latch from its connection with the means for engaging the latch in response to turning a key in the mortise key cylinder.

11. The mullion assembly of claim 9, wherein the means for extending the latch further comprises the auxiliary bolt which is configured to engage the means for engaging the latch, the auxiliary bolt being operably connected to the latch and acting to extend the latch in response to depression of the auxiliary bolt by the means for engaging the latch as the mullion is moved into contact with the means for engaging.

12. A mullion assembly mountable in a door frame, the mullion assembly comprising:

a bottom fitting attached to a floor said bottom fitting having means for fixedly engaging a mullion;

a top fitting attached to the door frame above the bottom fitting, the top fitting having a latch engagement assembly with a roller strike positioned to depress an auxiliary bolt;

a mullion defining a mullion cavity, the mullion being positionable in removable attachment between the bottom fitting and the top fitting;

a latch assembly positioned in the mullion cavity, the latch assembly having a latch extendable from the mullion cavity in response to depression by the latch engagement assembly of said auxiliary bolt attached adjacent to the latch, said latch engaging the latch engagement assembly of the top fitting and holding the mullion in a fixed position; and a key lock assembly connected to the latch assembly by an actuating link assembly, with the key lock assembly having a mortise key cylinder configured to downwardly move the actuating link assembly and retract the latch in response to turning a key in the mortise key cylinder, the key lock assembly permitting key controlled disengagement of the latch from the latch engagement assembly, followed by removal of the mullion from its position in the door frame.

* * * * *